US005090452A

United States Patent [19]

Dondi Benelli

[11] Patent Number: 5,090,452

[45] Date of Patent: Feb. 25, 1992

[54] PREVENTION OF WEFT STREAKS AFTER LOOM START UP

[75] Inventor: Dore Dondi Benelli, Marano Ticino, Italy

[73] Assignee: Ergotron S.a.s. di Dondi Benelli Dore & C., Novara, Italy

[21] Appl. No.: 496,709

[22] Filed: Mar. 21, 1990

[30] Foreign Application Priority Data

Mar. 21, 1989 [IT] Italy ..... 67196 A/89

[51] Int. Cl.[5] ..... D03D 49/12

[52] U.S. Cl. ..... 139/100; 139/110; 139/115; 139/116.2

[58] Field of Search ..... 139/97, 110, 109, 105, 139/349, 116.2, 100, 111, 115

[56] References Cited

U.S. PATENT DOCUMENTS

| | | | |
|---|---|---|---|
| 2,737,209 | 3/1956 | Meyer | 139/100 |
| 4,256,147 | 3/1981 | Deborde | 139/115 |
| 4,480,665 | 11/1984 | Imamura et al. | 139/97 |
| 4,564,050 | 1/1986 | Hirano | 139/110 |
| 4,750,527 | 6/1988 | Rehiling | 139/110 |
| 4,838,319 | 6/1989 | Suwa | 139/116.2 |

FOREIGN PATENT DOCUMENTS

| | | | |
|---|---|---|---|
| 0032902 | 7/1988 | Japan | 139/115 |
| 63-270842 | 11/1988 | Japan | 139/97 |
| 0668997 | 2/1989 | Switzerland | 139/97 |

*Primary Examiner*—Andrew M. Falik

*Attorney, Agent, or Firm*—Sughrue, Mion, Zinn, Macpeak & Seas

[57] ABSTRACT

In order to prevent the formation of weft streaks in cloth when a loom is restarted after a stoppage, the warp tension is reduced by a predetermined amount as soon as the stoppage occurs and the original warp tension is restored before restarting. The reduction in the warp tension prevents the tensile failure, that is, the plastic extension of the warp yarn, and ensures the exact repositioning of the beating-up line of the weft upon restarting.

7 Claims, 2 Drawing Sheets

PREVENTION OF WEFT STREAKS AFTER LOOM START UP

BACKGROUND OF THE INVENTION

The present invention relates to a method and a device for preventing the formation of streaks in the weft of the cloth when a textile loom is restarted after a stoppage.

Each time a loom is stopped for any reason (breakage of threads, momentary slackening of the feed tension, etc.) defects known as weft "streaks" in the cloth may be produced when the loom is restarted.

These streaks are more likely and more noticeable the longer the loom is stopped. The defects are also more marked when the yarn used in the weaving is of the type which is almost without resilience and likely to fail under tension. With such yarns, even a brief stoppage of the loom is sufficient to cause an extension of the cloth as well as of the yarn, with the consequent displacement of the beating-up line of the weft. In effect, when a stoppage of the loom occurs, the boundary between the cloth and the warp is displaced generally, as a result of the extension of the yarn, from the nominal position in which the sley of the loom beats the weft. According to the type of yarn used and the characteristics of the loom, the weaving line may be dispaced towards the warp beam or towards the cloth beam. In the first case, a weft streak of the type known as "overbeating" is formed in the fabric when the loom restarts: the first weft inserted when weaving restarts is too near the last weft inserted before the stoppage. This defect is perceptible visually as a thickening, almost a superposition, of the weft threads in the cloth.

In the second case, a streak of the type known as a "gap" is formed in the cloth when the loom restarts: the first weft inserted after restarting is too far from the last weft inserted before the stoppage.

In both cases, the piece of cloth produced has a defect which inevitably affects its market value.

Various devices for resolving the problems described above have been proposed. Thus, for example, the Italian patent application 68110-A/82, in the name of the same Applicant, proposed devices for detecting the size and direction of the displacement of the boundary between the warp and the cloth during a stoppage of the loom and for repositioning this boundary correctly immediately before weaving recommenced.

In European patent application No. 0184779, also in the name of the same Applicant, however, a system is proposed in which, immediately before the loom is restarted, the warp is rewound by an amount predetermined on the basis of the characteristics of the yarn, the loom and the duration of the stoppage, in order to compensate for the extension of the warp which has occurred during the stoppage.

The known devices produced hitherto and described above tend to remedy the problems stated above by attempting to compensate for their effects rather than by eliminating their cause.

SUMMARY OF THE INVENTION

The object of the present invention is to prevent the formation of weft streaks in cloth when a loom is restarted by eliminating the cause of the problems described above rather than by compensating for their effects.

This object is achieved, according to the invention, by means of a method characterised in that it comprises the steps of reducing the warp tension by a predetermined amount as soon as the loom stops and restoring the warp tension before the loom is restarted.

The invention also relates to a device for preventing the formation of weft streaks, the characteristics of which are defined in the appended claims.

In one embodiment, the device includes control means arranged to reduce the warp tension by rotating the warp beam and to restore the warp tension by reversing the rotation of the beam.

In the case of a loom with a warp-tension regulator including an electric motor for supplying the beam, the device according to the invention is characterised in that the rotation of the beam and the reduction and restoration of the warp tension are effected by the electric motor of the warp-tension regulator. The latter is conveniently constituted, for example, by a patented device produced and sold by the Applicant under the trade name "Tendilene".

In the case of a loom including a pivoted member (a "dancing" roller) for tensioning the warp threads, which is situated downstream of the warp beam and is adapted to tension the warp threads under the action of resilient biassing means, the device according to the invention includes detector means adapted to provide analog or digital electrical signals indicative of the position of the tensioner member and, at the restarting stage, the control means cause the reverse rotation of the warp beam until the signals provided by the detector means indicate that the pivoted tensioner member has returned to the position it occupied immediately before the reduction of the warp tension.

The slackening and re-tensioning of the warp threads may, however, also be achieved without acting on the warp beam by, for example, causing the lowering and subsequent raising of the pivoted deflector roller (dandy) by means of a geared-motor unit which acts (through a simple kinematic mechanism) on support levers of the roller.

BRIEF DESCRIPTION OF THE DRAWINGS

Further characteristics and advantages of the present invention will become clear from the detailed description which follows with reference to the appended drawings, provided by way of non-limiting example, in which.

DETAILED DESCRIPTION OF THE INVENTION

Figure 1:
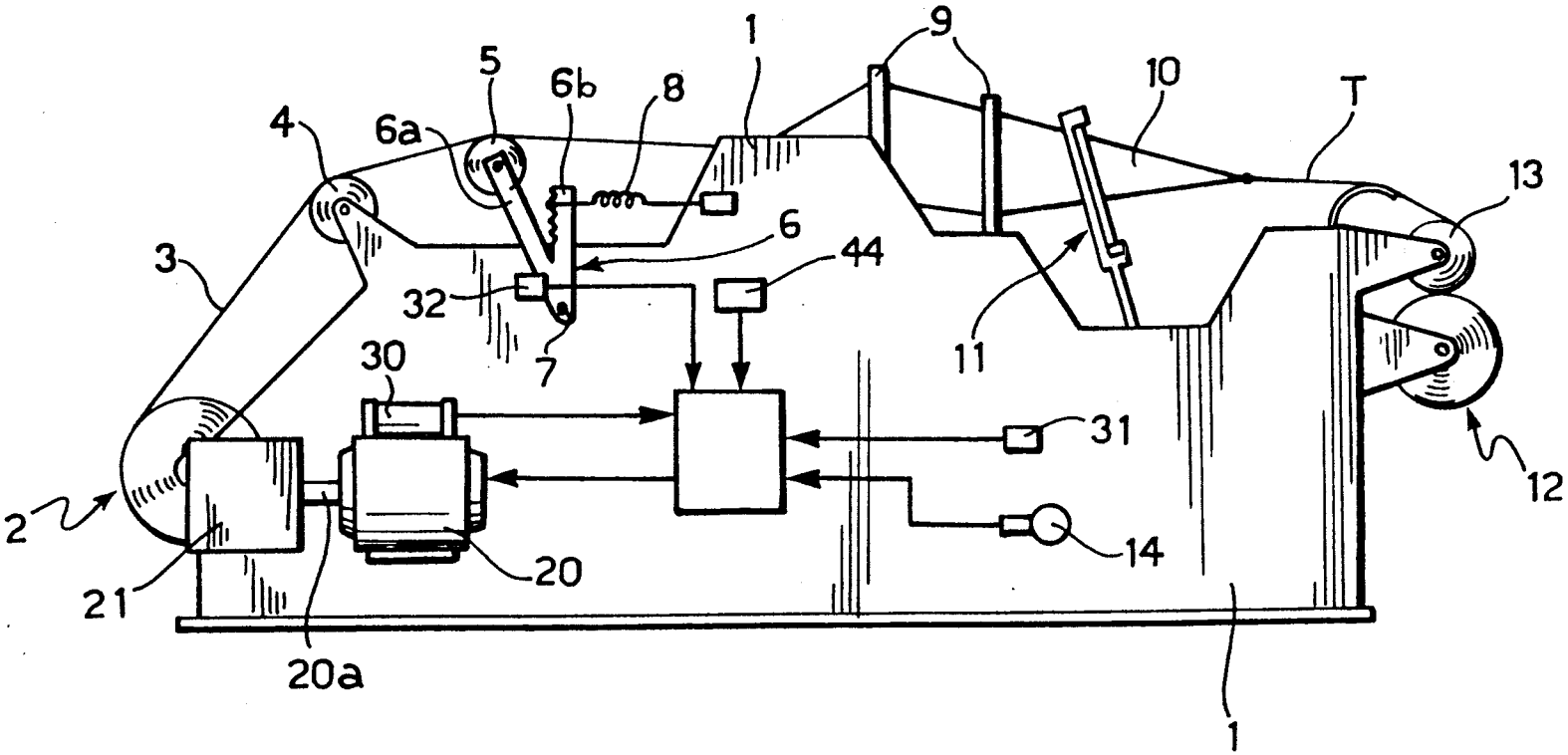
FIG. 1 shows schematically a textile loom provided with a device according to the invention.

FIG. 1 of the appended drawings shows schematically a textile loom comprising a support frame 1 one end of which carries a beam 2 on which the warp threads 3 are wound. These threads pass over a backrest roller 4 which is supported in a fixed position by the frame 1. A further tensioner roller (the so-called "dancing" roller), indicated 5, is carried by the first arms **6*a* of levers 6 (of which only one is visible in FIG. 1) which are articulated together in a V-shape and pivoted on the framework 1 at 7 such that the roller can be translationally displaced (i.e. the axis of the roller is displaced). Springs 8 connected to the second arms 6*b*** of the levers 6 are fixed to the framework of the loom and bias the thread-carrying roller 5 upwards.

Since the warp beam 2 is fixed, the warp threads 3 are deflected over the roller 4 and are thus kept tensioned by the roller 5 due to the action of the springs 8.

The warp threads 3 then reach a series of healds 9 which separate them into two arrays defining the warp opening or shed 10 in which the weft threads are inserted in succession during operation by devices of known type (and not illustrated).

A sley, indicated 11, beats up the weft to form the cloth T, usually with a pivoting motion, after the insertion of a weft. The piece of cloth is then wound onto a beam 12 by means of a draw beam 13. The beam 12 and the draw beam are also supported by the frame 1.

The main or driving shaft of the loom, from which the sley 11 and the healds 9 (amongst others) take their drive through kinematic transmission mechanisms (known and not illustrated), is indicated 14. An electric motor, indicated 20, is mounted on the frame 1 of the loom, adjacent the beam 2. This motor is, for example, a single-phase induction motor with a starting capacitor. The output shaft 20*a* of this motor rotates the warp beam 2 by means of a geared transmission system 21.

Preferably, but not necessarily, the electric motor 20 and the transmission 21 form part of a warp-regulator such as that mentioned in the introduction to the present description.

In the embodiment illustrated, a tachometric sensor 30 is coupled to the electric motor 20 and is of the type adapted to output a pulsed electrical signal whose frequency is indicative of the rate of rotation of the motor and hence of the speed at which the warp 3 is unwinding from the beam 2.

A loom stop-start sensor, that is, a sensor for sensing the operation of the loom is indicated 31. If the shaft 14 is driven by an electric motor, the sensor may be constituted simply by a relay in series with the supply of the electric motor so that the relay is envisaged (or de-energised) when the motor for operating the loom is supplied, and vice versa when the motor is stopped.

A sensor associated with the lever 6 which carries the roller 5 is indicated 32. This sensor is intended to output electrical signals indicative of the position assumed by the roller 5. It may be constituted, for example, by a sensor with an analog output, for example, a photoelectric sensor, a magnetic sensor or a Hall-effect sensor, or a strain gauge associated with the spring 8. Alternatively, the sensor 32 may be of the type with a digital output, such as, for example, a linear or rotary encoder.

Figure 2:
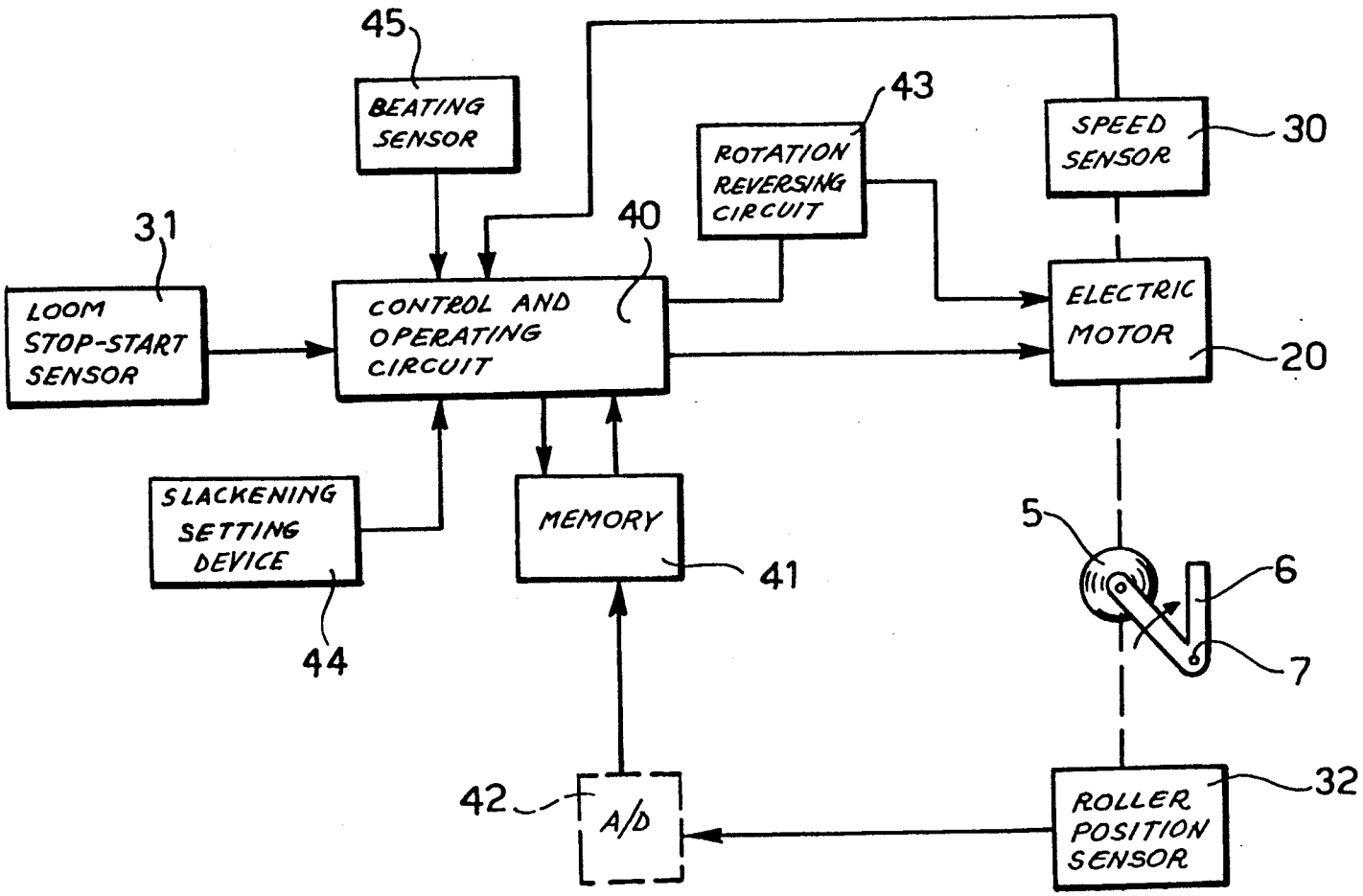
FIG. 2 is a circuit diagram, partially in block form, of one embodiment of a device according to the invention.

As can be seen from the diagram given by way of example in FIG. 2, the sensors 31 and 32 are connected to a control and operating circuit, generally indicated 40. This circuit is also connected to a memory device, indicated 41 in FIG. 2. The memory device is connected to the sensor 32 associated with the roller 5, possibly through an analog/digital converter (indicated 42 in FIG. 2) if the sensor 32 is of the type with an analog output.

The circuit 40 controls the operation of the motor 20 associated with the warp beam 2. The circuit also controls an inverter circuit 43 which is adapted to reverse the sense of rotation of the motor 20. This circuit is of known type and is arranged, for example, to switch the connection of the starting capacitor of the motor 20.

In operation, when the sensor 31 detects a stoppage of the loom, the control and operating circuit 40 activates the motor 20 of the warp beam 2, causing it to rotate so as to cause the warp thread 3 to unwind by a predetermined amount. This obviously reduces the tension of the warp threads 3 which is partly (but only partly!) taken up by the upward displacement of the roller 5 by the springs 8. The slackening of the warp threads is predetermined on the basis of the characteristics of the yarn or yarns constituting the warp, as well as the characteristics of the loom.

A manually-operated setting device, indicated 44 in the drawings, is connected to the control and operating circuit 40 and enables the desired quantitative value of the slackening of the warp tension to be set.

During the slackening of the warp-thread tension, the control and operating circuit 40 acquires the signals output by the tachometric sensor 30. From the pulses from the tachometric sensor 30, the control and operating circuit 40 can deduce, in the manner which will be described below, the effective degree of slackening of the warp tension. When the effective slackening corresponds to the desired amount set by the device 44, the control and operating circuit 40 stops the motor 20.

The reduction in the warp tension enables the warp threads to be kept within their elastic limits during the stoppage of the loom, thus preventing their tensile failure or inelastic extension.

Since the diameter of the warp beam 2 gradually decreases as weaving progresses and the motor 20 must therefore rotate the beam 2 at a progressively increasing rate, the frequency of the pulses of the tachometric sensor 30 also rises gradually as weaving progresses.

Thus, the control and operating circuit 40 cannot deduce the degree of effective slackening of the warp threads simply by counting the pulses provided by the tachometric sensor 30. In order for the number of pulses of the tachometric sensor 30 to be correlated correctly with the length of warp effectively unwound from the beam 2, the following solution may, for example, be adopted.

A beating sensor 45 is connected to the control and operating circuit 40 and is adapted, for example, to provide a pulse to the circuit each time the sley 11 operates during the normal operation of the loom. The circuit 40 may thus be arranged to count and store the number of pulses provided by the tachometric sensor 30 during the insertion of the last N wefts. This enables the circuit 40 to deduce the effective quantitative reduction in the tension in the warp threads from the number of pulses output by the sensor 30 during a warp-slackening stage when the loom stops.

The solution just described is explained in greater detail in European patent application 0184779 in the name of the same Applicant.

Immediately before the restarting of the loom, the control and operating circuit 40 switches on the motor 20 of the warp beam 2, after operating the invertor circuit 43 which reverses the sense of rotation of this motor. The beam 2 is thus rotated in the sense in which it re-tensions the warp threads 3. The rotation of the beam is stopped when the control and operating circuit 40 detects (on the basis of the information provided by the sensor 32) that the dancing roller 5 has returned to exactly the same position as it occupied when the controlled slackening of the warp threads was started previously. The system thus resets the loom to exactly the same operative conditions as existed immediately before the stoppage. In particular, the boundary between the warp and the cloth is returned exactly to its original position and, when weaving is recommenced, no weft streaks are formed.

The control and operating circuit 40 may be formed by electronic circuits with wired logic or with logic programmed with the use of a microprocessor. The memory devices 41 and any analog/digital converter 42 may in this case be formed in the same chip as the control circuit 40.

As seen above, as an alternative to the solution described by way of example, the slackening and the re-tensioning of the warp threads may also be achieved without intervening on the beam 2, for example, by the lowering and subsequent raising of the pivoted tensioner roller 5, for example, by means of a suitable geared-motor unit.

What is claimed is:

1. A device for a loom for preventing the formation of weft steaks in cloth when the loom is restarted after a stoppage, comprising:

control means adapted to reduce the tension of the warp by a predetermined amount by rotating a warp beam in a first direction as soon as the loom stops, and to restore the tension of the warp before the loom restarts by rotating the warp beam in a second direction reverse from said first direction;

motor means for rotating the beam of the warp;

manually-operated means for setting the desired quantitative slackening of the tension in the warp;

sensor means for sensing the effective quantitative slacking of the tension in the warp; and control means for causing the warp beam to be rotated by the motor means to slacken the warp until the effective slackening of the warp corresponds to the desired quantity set.

2. A device according to claim 1, further comprising a warp-tension regulator device including an electric motor for rotating the beam of the warp, wherein the motor means are constituted by the electric motor of the warp-tension regulator device.

3. A device according to claim 1, further comprising a pivoted tensioner member downstream of the beam of the warp for tensioning the warp threads, detector means for providing analog or digital electrical signals indicative of the position of the tensioner member;

the said control means being connected to the detector means and, at the stage of the resetting of the tension of the warp being, adapted to cause the reverse rotation of the beam of the warp until the signals provided by the detector means indicate that the pivoted tensioner member has returned to the position it occupied immediately before the reduction in the tension of the warp.

4. A device for preventing the formation of weft streaks in cloth when a loom is restarted after a stoppage, comprising:

control means adapted to reduce the tension of the warp by a predetermined amount as soon as the loom stops, and to restore the tension of the warp before the loom restart, and including motor means for lowering and subsequently raising by a predetermined amount a pivoting roller for tensioning the warp threads so as to cause a corresponding slackening and re-tensioning of the warp, respectively.

5. A method for preventing the formation of weft streaks in cloth including warp threads when a loom is restarted after a stoppage, comprising the steps of:

reducing the tension in the axial direction of the warp threads by a predetermined amount as soon as a stoppage of the loom occurs, and restoring said tension of the warp immediately before the loom is restarted, wherein the reduction and restoration of the tension of the warp are achieved by means of a controlled translational displacement of a roller in a non-axial direction for tensioning or deflecting the warp threads.

6. A method of preventing the formation of weft streaks in cloth when a loom is restarted after stoppage, said loom having a warp beam around which a warp is wound and supplied therefrom, comprising the following steps:

manually setting the desired quantitative slackening of the tension in said warp during stoppage of said loom;

reducing the tension in said warp by rotating said warp beam in the direction causing said warp to unwind therefrom until the effective slackening of the warp corresponds to the desired quantity set;

sensing the effective quantitative slackening of the tension in said warp; and restoring the tension in said warp by rotating said warp beam in a direction causing said warp to be wound therearound immediately before the loom is to be restarted.

7. The method of claim 6, wherein said steps of reducing and restoring the tension in said warp comprises the additional step of controlling the displacement of a roller which abuts against said warp for deflecting said warp.

* * * * *